US005584308A

United States Patent [19]

Maekawa

[11] Patent Number: 5,584,308

[45] Date of Patent: Dec. 17, 1996

[54] PERMANENT WAVE METHOD AND APPARATUS

[76] Inventor: Seiji Maekawa, 11-1, Kamejima 1-chome, Nakamura-ku, Nagoya, Japan

[21] Appl. No.: 427,180

[22] Filed: Apr. 21, 1995

[51] Int. Cl.[6] ..... A45D 7/04

[52] U.S. Cl. ..... 132/203; 132/200; 132/202; 132/206; 132/210

[58] Field of Search ..... 132/202, 203, 132/206, 210, 211, 200

[56] References Cited

U.S. PATENT DOCUMENTS

| | | | |
|---|---|---|---|
| 2,056,358 | 10/1936 | Malone et al. | 132/206 |
| 2,061,709 | 11/1936 | Malone et al. | 132/206 |
| 3,768,490 | 10/1973 | Kalopissis et al. | 132/203 |
| 4,481,961 | 11/1984 | Bauer et al. | 132/203 |
| 4,840,791 | 6/1989 | Mathews et al. | 132/203 |
| 4,935,230 | 6/1990 | Naito et al. | 132/206 |
| 5,071,641 | 12/1991 | Lewis | 132/206 |

FOREIGN PATENT DOCUMENTS

| | | |
|---|---|---|
| 54-106355 | 8/1979 | Japan . |
| 58-3102 | 1/1983 | Japan . |
| 59-162803 | 10/1984 | Japan . |
| 60-179202 | 11/1985 | Japan . |
| 63-55904 | 4/1988 | Japan . |

*Primary Examiner*—Gene Mancene

*Assistant Examiner*—Pedro Philogene

*Attorney, Agent, or Firm*—Lowe, Price, LeBlanc & Becker

[57] ABSTRACT

A permanent wave method includes a first step of applying a reducing agent (12) to hair (10) to be permed. At this point of time the hair (10) is not yet curled around a rod and is still straight. Then, the hair is covered with a cap of vinyl, and is left in this condition until the hair is brought into a first reduced condition in which the hair is sufficiently soft and plastic to be wrapped around a rod without cracking or straining. Thereupon, the reducing agent remaining on the hair is washed away. Then, the hair is wrapped, or curled, around a rod (13), and is covered with a vinyl cap (16). Thereupon, the hair is heated in its entirety, from its root up to its end. As a result, the hair is brought into a second reduced condition in which the hair is locked in the curled pattern about the rod (13). Then, cap (16) is removed. Then, an oxidizing agent (17) is applied to the hair, and is left in this condition until the hair has been locked into a more stable curled pattern. Thereafter, rod (13) is removed from the hair, and the hair is then washed with water and is allowed to dry, completing the process of making a permanent wave. Permanent wave apparatus may be used to determine automatically whether the reduction reaction initiated in the hair by application of the reducing agent thereto has resulted in the first reduced condition of the hair. The apparatus comprises a temperature sensing device (21), a temperature indicating/alarm device (22), and a thermal insulation cap (36).

12 Claims, 7 Drawing Sheets

PERMANENT WAVE METHOD AND APPARATUS

FIELD OF THE INVENTION

This invention relates to a permanent wave method and an apparatus for practicing it.

BACKGROUND OF THE INVENTION

As is very well known, permanent wave is a method of styling the hair in which chemical preparations are applied to the hair to reduce and oxidize the hair so that the hair is set in waves or curls that last for several months.

A conventional permanent wave method involves winding a bunch of hair 1 on a rod (curler) 2 (FIG. 7(A), applying a first permanent wave solution, or a reducing agent 4, to the hair (FIG. 7(B)), and either leaving the hair in this condition under the normal temperature or heating it until it has been reduced, or softened. Then, a second permanent wave solution, or an oxidizing agent 5, is applied to the hair 1 (FIG. 7(C)), and the hair is left in this condition until the hair has been locked in the curled pattern.

Before the hair is wound on the rod 2, the end of the hair is covered with an end paper 6. The end of the hair is first held to the rod, and then the hair is wound on the rod. It is a usual practice.

Also, usually, as indicated above and as shown in FIG. 7(B), the reducing agent 4 is applied to the hair by using an applicator after the hair has been wound on the rod.

With the conventional permanent wave method, however, the reducing agent is applied to the hair after the hair has been wound on a rod and, hence, it is not easy to exactly apply a required amount of reducing agent to the hair and, therefore, reduction reactions may proceed at different rates in the different bunches of hair. Thus, the different bunches of hair may be permed into different curled patterns.

Also, since the reducing agent is applied to the hair already wound on the rod, some of the reducing agent gathers in the end paper 4, so that the end portion of the hair may be treated excessively. In addition, if an excessive amount of reducing agent is on a portion of the hair due to the gathering of it in the end paper, the oxidizing agent does not readily get fixed to that portion and, thus, the hair is not locked sufficiently in the curled pattern at that portion, with the result that that portion of the hair is very likely to be damaged.

Moreover, with the conventional permanent wave method, when the hair gets wound on a rod, the hair is still relatively hard as it is not yet reduced at this point of time. So, as shown in FIG. 8, winding the hair on the rod is likely to produce cracks 8 or strains 9 in the cuticle of the hair. Hair with cracks or strains may lose its gloss or softness by being permed.

SUMMARY OF THE INVENTION

Accordingly, it is an object of the invention to provide a permanent wave method that is free from the foregoing drawbacks of the conventional method.

Another object of the invention is to provide a permanent wave method wherein a reducing agent is applied to hair before the hair is wound on a rod. With such a method, therefore, the possibility of cracks or strains being produced in the hair is greatly reduced. Also, there is no possibility of the reducing agent gathering in an end paper.

It is a further object of the invention to provide a permanent wave apparatus that can be used to automatically determine whether a reduction reaction initiated in the hair by applying the reducing agent to the hair has proceeded to a stage where the hair is sufficiently soft and plastic to be wound on a rod without producing a crack or strain in the hair.

According to the invention, both reducing agent and oxidizing agent act effectively on the hair in a well-balanced manner, so that the hair can be permed into a regularly curled pattern. Also, the hair can be permed without losing its gloss and softness. In addition, the end of the hair is not treated excessively.

According to the permanent wave method of the invention, a reducing agent is first applied to hair, and the hair is left in this condition until the hair has been brought into a first reduced condition in which the hair is sufficiently soft and plastic to be curled to a desired pattern without producing a crack or strain in the hair. Then, the reducing agent remaining on the hair is washed away. Thereupon, the hair is curled to a desired shape or pattern, and is held in this pattern. Then, the hair is heated until it has been brought into a second reduced condition in which it is locked in the desired curled pattern. Thereupon, an oxidizing agent is applied to the hair, which is then left in this condition until it has been locked in a more stable waved pattern.

The hair can be held in the desired curled pattern by wrapping the hair around a rod, as is usually done.

There may be used a reducing agent that contains an ammonium salt of thioglycolic acid as an effective component.

Also, the reducing agent may be one that contains free ammonium as alkali.

Also, the oxidizing agent may contain sodium bromate as an effective component.

There may be used an oxidizing agent that contains hydrogen peroxide as an effective component.

The permanent wave apparatus of the invention includes a thermal insulation cap including at least one multilayer sheet which consists of a central sheet containing air bubbles and two sheets joined to opposed sides. Each sheet joined to the central sheet has the property of reflecting heat ray. The apparatus also includes a temperature detecting device to be placed on hair after a reducing agent has been applied to the hair. This detecting device has a temperature sensor mounted on a heat-insulating mat for detecting the temperature of the hair surface. The temperature sensor is covered with a covering provided with plural openings through which air passes smoothly. In addition the apparatus also has a temperature indicating device which is electrically connected to the temperature sensor. This indicating device indicates the temperature of the hair surface as detected by the temperature sensor. Also, the temperature indicating device is provided with means for setting a first upper limit of the hair surface temperature, or the surface temperature of the hair when a reduction reaction initiated in the hair by applying the reducing agent thereto has resulted in the first reduced condition of the hair. Also, the temperature indicating device has means for sounding an alarm at the same time that the temperature indicating device indicates the first upper limit of the hair surface temperature.

The covering of the temperature detecting device may be one of a semicircular shape.

According to the permanent wave method of the invention, a reducing agent is applied to hair before the hair is wrapped around a rod. That is, the reducing agent is applied to the hair when the hair is still straight. So it is easy to apply the reducing agent to the different portions of the hair in required different amounts. For example, it can be applied to the root portion of the hair in a larger amount than to the end portion in order to cause reduction reaction to proceed in the root portion at a greater rate. Also, if the hair has a damaged portion, the reducing agent can be applied to that portion in a decreased amount so that only a moderated reduction reaction will occur in the damaged portion.

With the prior art, as indicated above, since the reducing agent is applied to the hair already wound on a rod, some of the reducing agent gathers in an end paper that covers the end portion of the hair, so that the end portion thereof may be treated excessively. With the invention, however, since the reducing agent remaining on the surface of the hair is washed away before the hair is wound on a rod, there is no possibility of the reducing agent gathering in an end paper. Moreover, with the invention, when the hair gets wound on a rod, the hair is already in the first reduced condition, or is sufficiently soft and plastic to be wound to a desired pattern without producing a crack or wrinkle in the hair.

Also, no amount of reducing agent is remaining on the hair when the oxidizing agent is applied to the hair, so the oxidizing agent readily contacts the hair, and gets fixed uniformly to the entire length of the hair. That is, no chemical preparation is on the hair when the oxidizing agent is applied to the hair and, thus, the oxidizing agent flows quickly up to the end of the hair by virtue of capillary action, with the result that oxidation reaction proceeds uniformly in the hair.

The above and other objects of the invention, as well as other features thereof, will become apparent from the following description of a preferred embodiment of the invention as illustrated by the accompanying drawings.

DETAILED DESCRIPTION OF PREFERRED EMBODIMENT

The invention will now be described in detail with reference to the drawings.

Figure 1:
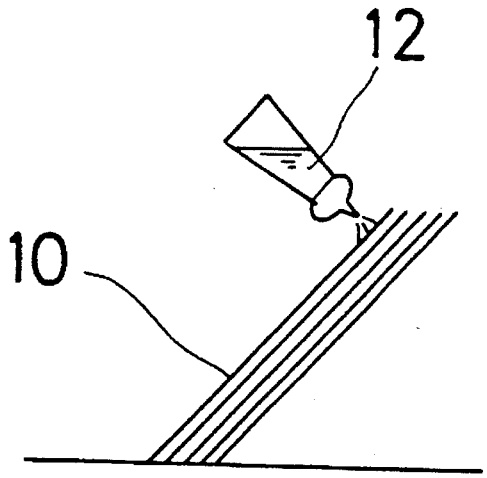
FIGS. 1(A)–1(C) and 2(A)–2(B) illustrate different steps of a permanent wave method of the invention.
Figure 1:
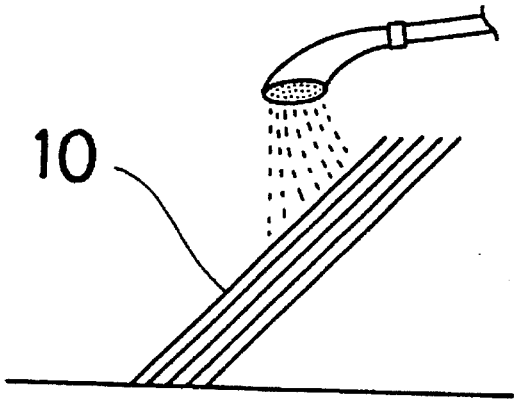
Figure 1:
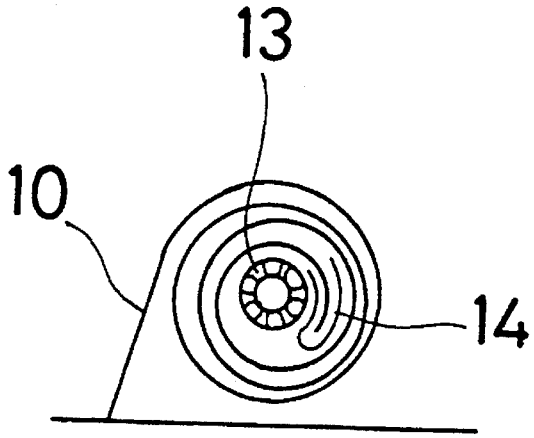
Figure 2:
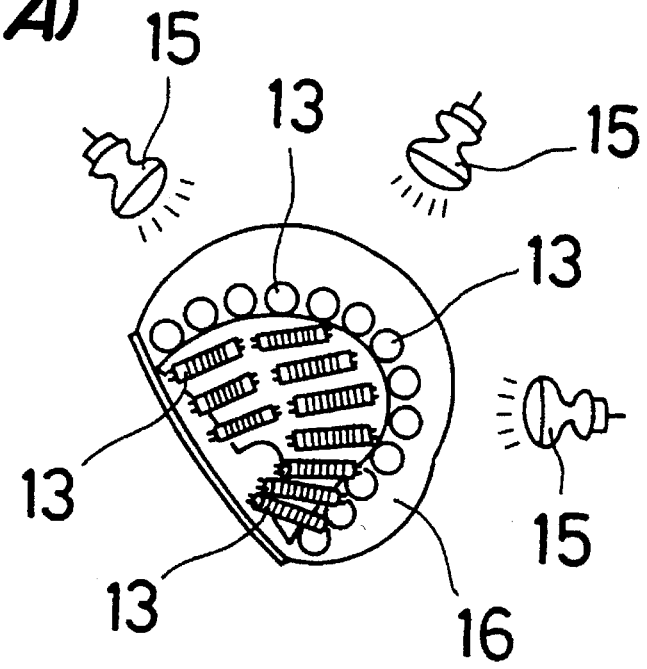
Figure 2:
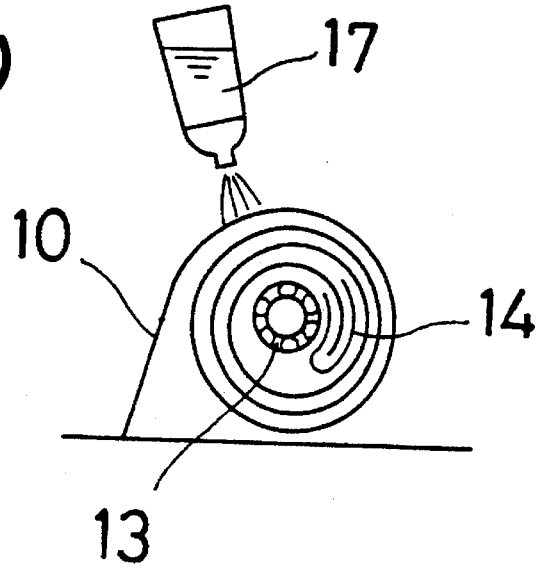

Referring to FIGS. 1 and 2, after hair 10 to be permed has been examined, a first permanent wave solution, or a reducing agent 12, is first applied to the hair 10 as shown in FIG. 1(A). At this point of time the hair 10 is still straight, because it is not yet curled around a rod. The reducing agent 12 is applied to the length of the hair 10 uniformly, but in an amount decreased gradually from the root of the hair toward its end. Then, the hair 10 is covered with a cap of vinyl ( not shown) until the hair 10 has been placed in a first reduced condition in which the hair is sufficiently soft and plastic or moldable to be wrapped around a rod 13 without producing a crack or strain in the hair.

As for the length of time for which to cover the hair with the vinyl cap, it should be preferably between 5 and 30 minutes, depending upon the quality of the hair. More preferably the hair 10 should be covered with a thermal insulation cap 36 of a permanent wave apparatus that will be described later until the hair has reached a predetermined surface temperature.

The reason why the amount of reducing agent 12 applied to the hair is made gradually smaller toward its end is that the nearer to the end of the hair the different portions of the hair, the smaller their chemical resistances to the reducing agent. That is, if the reducing agent is uniformly applied to the length of the hair 10, the portions of the hair nearer to its end will very likely be excessively reduced.

Also, the reducing agent 12 should preferably be one for a cold permanent wave. To be more specific, it is preferable to use a reducing agent that contains an ammonium salt of thioglycolic acid as an effective component. Moreover, the reducing agent 12 should preferably contain alkali that contains free ammonium as an effective component.

Also, the reducing agent 12 should preferably have sufficient viscosity that the reducing agent can be easily applied to the different portions of the hair 10 in required different amounts.

After being placed in the first reduced condition, the reducing agent remaining on the hair 10 is washed away, as shown in FIG. 1(B). For this purpose, if desired, a commercially available rinsing solution may be used. This washing is done to prevent the hair being curled (waved) excessively as well as to facilitate the work of curling the hair and prevent the person doing this work from hurting his or her fingers.

Then, the end of the hair 10 is covered with an end paper 14 as shown in FIG. 1(C), and is fastened to a rod or curler 13 with a rubber band or other suitable means. Then, as shown in FIG. 1(C), the hair is wrapped, or curled, around the rod 13. If the hair, now being in the first reduced condition, is exposed to the air for a long length of time, the hair will be oxidized by the air, so that the hair will be difficult to lock in a curled pattern when heating it. Thus, the hair should be wrapped around the rod 13 as quickly as possible, and then also should be covered with a cap 16 of vinyl (FIG. 2(A)) as soon as possible in order to prevent the hair from drying.

After being covered with the cap 16, the hair is heated with heating devices 15 such as far-infrared radiation lamps, as shown in FIG. 2(A). For example, it may be preferable to set the heating device 15 at such a heating temperature that the bunch of hair 10 wrapped around the rod 13 will be heated to 55° C. or so at its surface. As for the time for which to heat the hair, it can be set depending upon the length and quality of the hair and similar factors. For example, short hair can be heated for about 10 minutes, and long hair for about 30 minutes.

Then, the hair should be entirely heated from its root to its end until the whole hair has been locked in the curled pattern about the rod 13. This locked condition will be hereafter referred to as a "second reduced condition." When the hair has reached this condition, the heating of it is stopped. If, for example, touching the rod 13 with a palm does not change the temperatures of the rod and of the hair, it shows that the heat has been sufficiently transmitted up to the end of the hair. However, if the heat is not transmitted up to the end of the hair, the inside of the rod 13 is still at a low temperature and, hence, touching the rod lowers the temperatures of the rod and of the hair.

During the heating of the hair by the heating devices 15, if desired, at regular intervals of time some of the rods may be removed from the hair and it can be checked to what degree the hair has been locked in the curled pattern.

Figure 6:
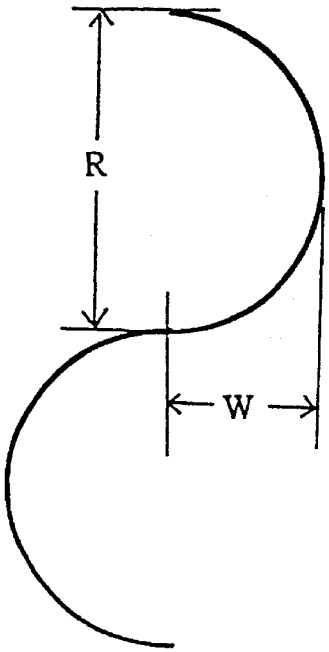
FIG. 6 shows the end-to-end dimension R of curl and the end-to-top dimension W of curl.
Figure 7A:
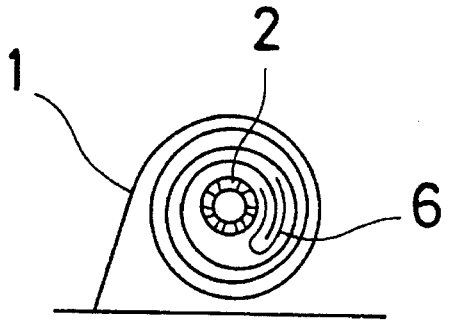
FIG. 7(A) PRIOR ART
FIGS. 7(A)–7(C) show the conventional permanent wave method.
Figure 7B:
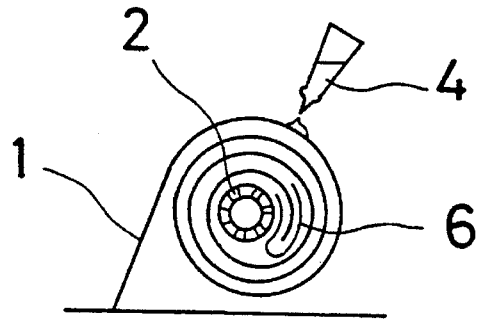
FIG. 7(B) PRIOR ART
Figure 7C:
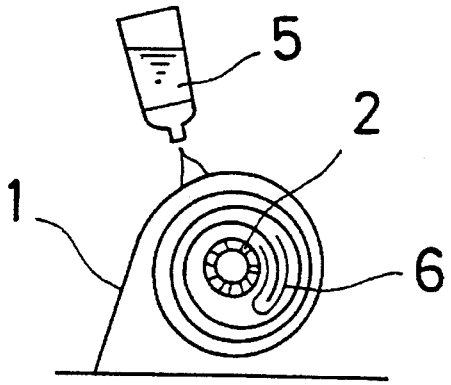
FIG. 7(C) PRIOR ART
Figure 8:
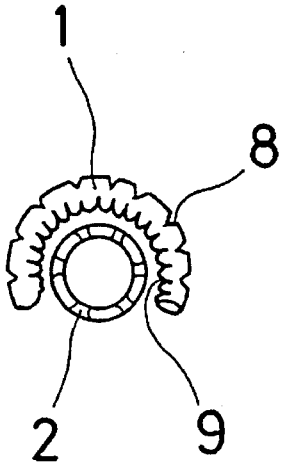
FIG. 8 PRIOR ART
FIG. 8 shows hair curled around a rod 2 in the prior art.
Figure 9:
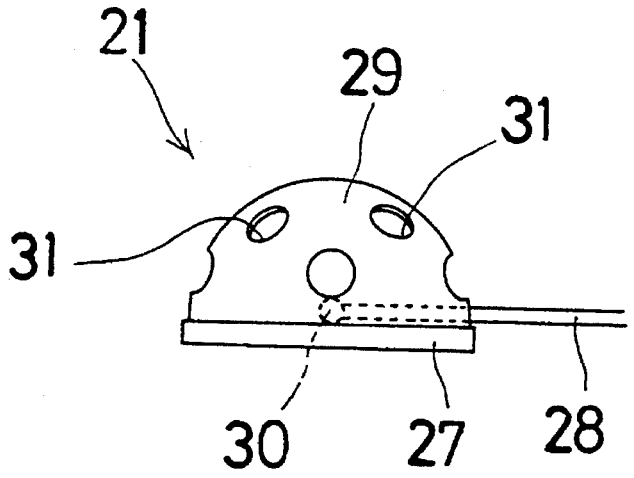
FIG. 9 shows one component of a permanent wave apparatus (of FIG. 15) of the invention, namely, a temperature detecting device 21. The permanent wave apparatus can be used to determine whether a reduction reaction initiated by applying the reducing agent to hair has resulted in the first reduced condition of the hair.
Figure 10:
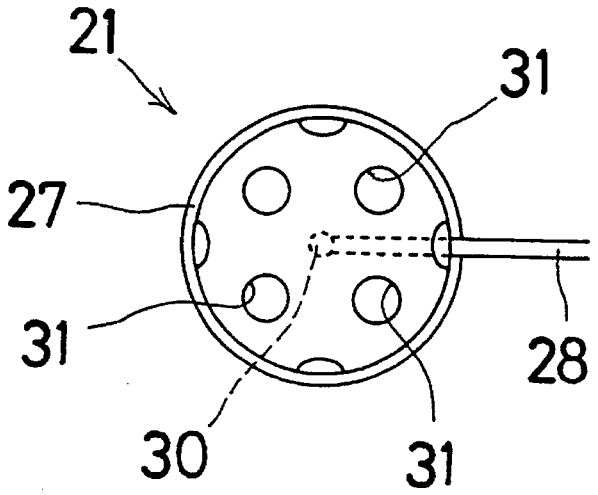
FIG. 10 is a plan view of the temperature detecting device 21 of FIG. 9.

Referring to FIG. 6, a desired end-to-end dimension R of curl can be obtained by using a rod that is about two thirds of the desired dimension R. Also, a desired end-to-top dimension W of curl, which depends upon to what degree of closeness to the curvature of the outer circumference of the rod one wishes to curl the hair, can be $2 \times W = R$ as a maximum. In order to have a great degree of this closeness, the hair 10 may be heated until it reaches a surface temperature of 60° C. or so. By so doing, W is made nearer to R. In order to have a small degree of this closeness, however, the hair 10 may be heated only to a surface temperature of about 50° C. The longer the hair, the longer can the hair be heated so that the entire length of the hair will have a desired great degree of closeness.

When the hair has reached the second reduced condition, the cap 16 is removed, and then a second permanent wave solution, or an oxidizing agent 17, is applied to the hair (FIG. 2(B)) by using a convenient device such as an applicator. The hair is left in this condition to allow the oxidizing agent to soak into the hair. As a result, the hair is locked into a more stable curled pattern. Then, the rod 13 is removed from the hair. Thereupon the hair is washed with water and is allowed to dry. It completes the whole process of making a permanent wave.

Oxidizing agent containing sodium bromate or hydrogen peroxide should preferably be used.

The permanent wave method of the invention has the following advantages in connection with the applying of the reducing agent to hair:

(1) Since the reducing agent 12 is applied to the hair before the hair is wrapped around a rod, the reducing agent can be easily applied to the different portions of the length of the hair in required different amounts that depend upon the quality of the hair. Therefore it is possible to make the oxidation reaction proceed at a required rate.

Figure 3:
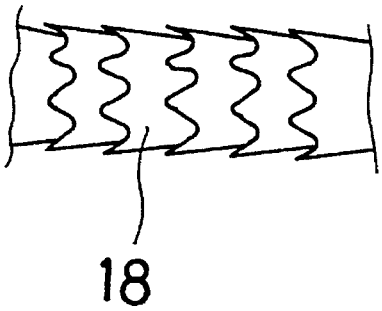
FIG. 3 shows the cuticle of hair.
Figure 4:
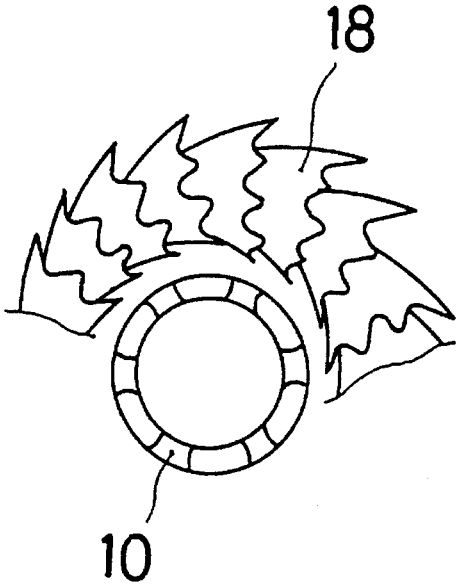
FIG. 4 also shows the cuticle of hair, but concerns the prior art, where a reducing agent is applied to the hair only after the hair has been curled around a rod.

(2) Also, when the reducing agent is applied to the hair, the hair is straight with the scale-shaped portions of its cuticle closed (FIG. 3) and, therefore, the protein contained in the hair is unlikely to come out, so that there is little possibility of damage to the hair. With the prior art, however, since hair is wrapped around a rod without applying a reducing agent thereto, the hair is not yet softened sufficiently at the time of wrapping. So wrapping the hair the around a rod opens the scale-shaped portions of the cuticle 18 of the hair, with the result that the protein contained in the hair is apt to get out and cause damage to the hair.

Figure 5:
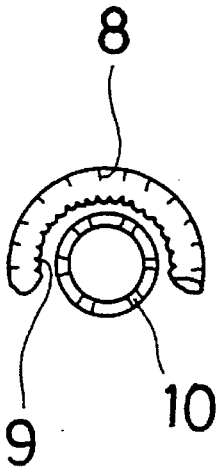
FIG. 5 shows hair curled around a rod 10 according to the invention. According to the invention, a reducing agent is first applied to the hair to bring the hair into a first reduced condition in which the hair is sufficiently resilient. Thereupon the reducing agent remaining on the hair is washed away, and then the hair is curled around the rod 10. When the hair is curled around it, the cuticle of the hair elongates or contracts, as the hair is already sufficiently resilient. Thus, curling the hair around the rod 10 is very unlikely to produce cracks 8 or strains 9 in the hair.

Also, the permanent wave method of the invention has the following merits concerning the wrapping of the hair around a rod:

(1) When the hair is wrapped around a rod, the cuticle of the hair elongates or contracts, as the hair is already in the first reduced condition and thus is highly resilient. Wrapping the hair around a rod, therefore, is unlikely to produce cracks or strains in the hair (FIG. 5). Permanent waves, therefore, can be made without losing the gloss or softness of the hair.

(2) The hair in the first reduced condition can be easily wrapped around a rod as the hair is sufficiently soft and pliable.

(3) Directly after the hair has reached the first reduced condition, the reducing agent remaining on the hair is washed away, so the hands of the person doing the work of wrapping the hair around a rod does not become very rough.

(4) The hair is locked in the curled pattern by heating the reducing agent that has soaked into the hair. Therefore it is easy to predict how many times the diameter of the rod used the desired curl will have. So it is easy to decide which rod to use in order to make a desired permanent wave, and a desired magnitude of curl and a desired degree of closeness of curl to the curvature of the outer circumference of the rod can be obtained easily by selecting a suitable diameter of rod and a suitable amount of heat supplied to the hair.

In addition, the permanent wave method hereof has the following advantages in connection with the heating of the hair:

(1) As indicated previously, at the time of first reduction, the amount of reducing agent 12 applied to the hair is made smaller toward the end of the hair and, therefore, the reducing agent soaks into the root portion of the hair (i.e., the portion of the hair nearer to its root) in a larger amount than into the end portion thereof (i.e., the portion of the hair nearer to its distal end). Accordingly, at the time of second reduction, the further from the rod the different portions of the bunch of hair wrapped around the rod, the higher the temperatures of those portions. Accordingly the hair wrapped around the rod is locked in the curled pattern most firmly at its portion farthest from the rod, that is, at its root portion.

(2) Before the hair is wrapped around a rod, the reducing agent remaining on the hair is washed away. Therefore, when the hair is in the state of being wrapped around the rod, there is no accumulation of the reducing agent on the end portion of the hair. Also, the end portion of the hair is maintained at a relatively low temperature, Accordingly, the end portion of the hair is not curled excessively, and is not locked very firmly in the curled pattern.

(3) As described above, the root portion of the hair is locked in the curled pattern more firmly than the end portion thereof. Thus a permanent wave made by the invention will last for a longer period of time. By contrast, with the prior art, applying a reducing agent to the hair (as wrapped around a rod) results in a greater amount of it being put on its end portion than on its root portion, and this result, coupled with the fact that the root portion of the hair naturally has a greater circumference than the end portion thereof (which is also of course the case with the invention), causes the root portion thereof to be curled to a greater dimension than its end portion is, so that the curl of the root portion will last only for a shorter period of time than that of the end portion.

In addition, the permanent wave method of the invention has the following good points in connection with the applying of the oxidizing agent to the hair:

(1) When the oxidizing agent is applied to the hair, no amount of reducing agent is remaining on the hair. Therefore the oxidizing agent can certainly be spread uniformly over the whole length of the hair and, hence, an oxidation reaction proceeds uniformly over the hair with little possibility of damage to the hair.

(2) The oxidizing agent goes readily between the hairs, so oxidation reaction will be complete only in a short period of time and, therefore, the whole process of making desired permanent waves only requires a short time.

Thus, each operation in the permanent wave method can be performed easily. Also, both the reducing agent and the oxidizing agent act effectively on the hair in a well-balanced manner, so that the hair is treated into a stable curled pattern. In addition, there is only a small possibility of damage to the hair, so desired permanent waves can be made without losing the gloss and softness of the hair.

Also, according to the invention, it is easy to predict to what a curled condition the hair will be finished, so that a desired hairstyle can be easily made.

Although in the above embodiment of the invention a rod 13 with a circular cross section is used, a rod with a polygonal cross section can also be used to make a curl of a similar shape.

Also, according to the invention, naturally curly hair can be straightened by holding the hair straight and performing the same operations as described above except that no rod is used.

An apparatus suitable for use in practicing the abovementioned permanent wave method of the invention will now be described with reference to FIGS. 9 to 15.

Permanent wave apparatus has a temperature sensing device 21 (FIGS. 9 and 10), a temperature indicating/alarm device 22 (FIGS. 11 and 15), and a thermal insulation cap 36 (FIGS. 13 to 15), and is used to determine automatically whether the reduction reaction initiated in the hair by applying the reducing agent to thereto has resulted in the first reduced condition of the hair.

The temperature sensing device 21 has a temperature sensor 30 mounted on the center of the upper surface of a circular heat-insulating mat 27 that is formed of, for example, styrene foam. The temperature sensor 30 is surrounded by a covering 29 secured to the circumference of the mat 27. The covering 29 is provided with plural air openings 31 that are equally spaced from each other. The outside air smoothly enters the covering 29 from these openings 31. An electrical cord 28 is connected to the temperature sensor 30 at one end thereof, and is passed through one of the lower air openings 31 of the covering 29, and has an opposed end connected to an input terminal of the temperature indicating device 22.

Although the covering 29 has a semicircular shape in the illustrated embodiment, a covering of a cylindrical shape, of a cubic shape, or of other shape that has a closed bottom can also be used. However, the semicircular covering 29 is preferred because it only has a small outer surface and, hence, there is only a small possibility of the covering 29 coming into contact with the thermal insulation cap 36 and, consequently the temperature inside the semicircular covering 29 is very unlikely to be affected by the temperature of the thermal insulation cap 36.

Figure 11:
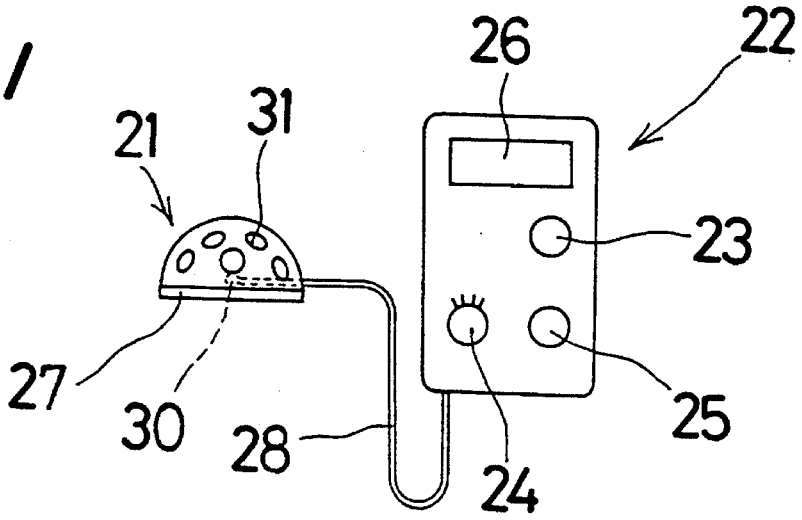
FIG. 11 shows the temperature detecting device 21 and another component of the permanent wave apparatus, namely, a temperature detecting/alarm device 22.

As shown in FIG. 11, the temperature indicating/alarm device 22 has a power switch 23, a temperature setting dial 24, an alarm section 25, and a temperature-indicating window 26. The window 26 indicates digitally the hair temperature as detected by the temperature sensor 30. When the reduction reaction initiated by applying the reducing agent to the hair has resulted in the first reduced condition of the hair, then the reducing agent remaining on the hair must be washed away to terminate the reduction reaction (first reduction reaction). Accordingly, the temperature of the hair when the reduction reaction has resulted in the first reduced condition thereof, which depends upon such factors as the desired magnitude of curl and the desired degree of closeness of curl to the curvature of the outer circumference of the rod, can be set by using the temperature setting dial 24.

The temperature of the hair when reduction reaction has resulted in the first reduced condition of the hair will be hereafter referred to as a "first upper limit of hair temperature." As the first upper limit of hair temperature varies from hair to hair, it is necessary to determine this upper limit and make a record of it when perming each individual hair for the first time. For example, where there is used a reducing agent containing an ammonium salt of thioglycolic acid with free ammonium, it is preferable to set the first upper limit of hair temperature at 25° to 30° C.

The alarm section 25 of the temperature indicating/alarm device 22 sounds an alarm at the same time that the temperature indicating window 26 indicates the first upper limit of hair temperature as set with the setting dial 24.

Figure 12:
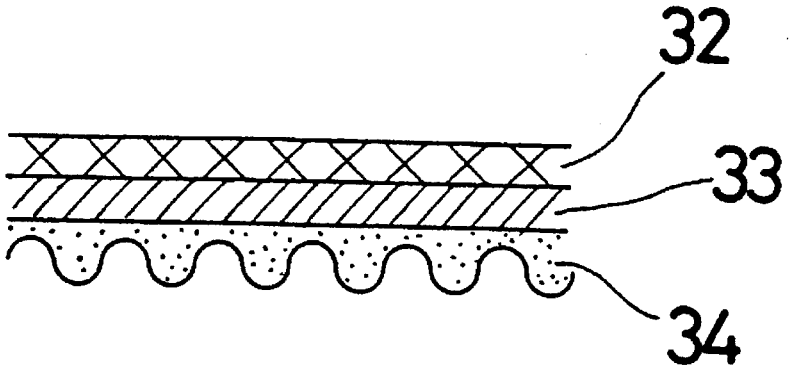
FIG. 12 is a vertical cross section of a multilayer sheet used to construct a thermal insulation cap 36 (of FIG. 13)
Figure 13:
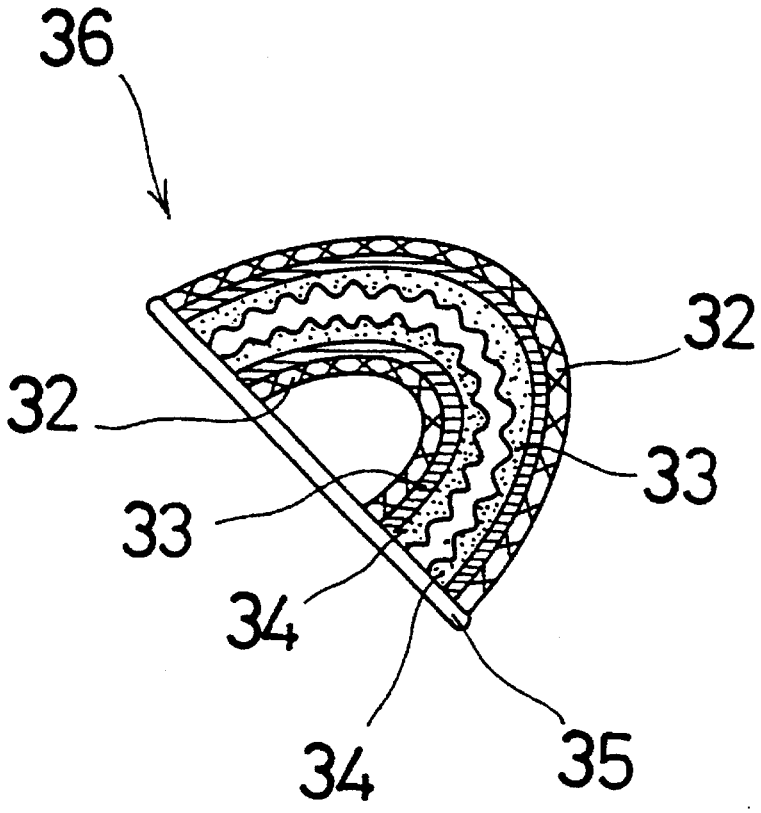
FIG. 13 shows a thermal insulation cap 36 which is also one component of the permanent wave apparatus.
Figure 14:
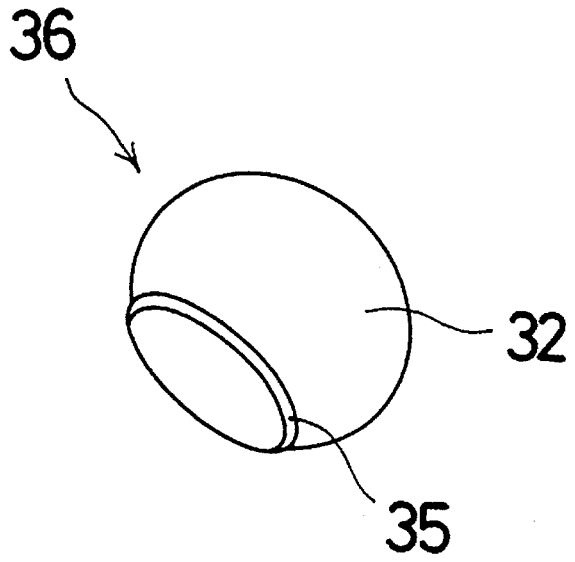
FIG. 14 is a perspective view of the cap 36.

The thermal insulation cap 36 is formed by stitching two multilayer sheets together (FIG. 13). Each sheet is constructed as shown in FIG. 12. That is, aluminum vapors are first deposited on a film 33 with no air permeability, thereby forming an aluminum vapor layer 32 on the film 33. Then, to the other side of the film 33 is stitched a sheet 34 of urethane foam, thus providing one multilayer sheet. Then, as shown in FIGS. 13 and 14, the two multilayer sheets are stitched together with their aluminum vapor layers 32 oriented outward and inward, respectively. Thus, a hood-shaped cap 36 with an open bottom is formed. An elastic string 35 is passed through the lower end of the cap 36, and this string 35 can be stretched to contract the open bottom of the cap 36.

Figure 15:
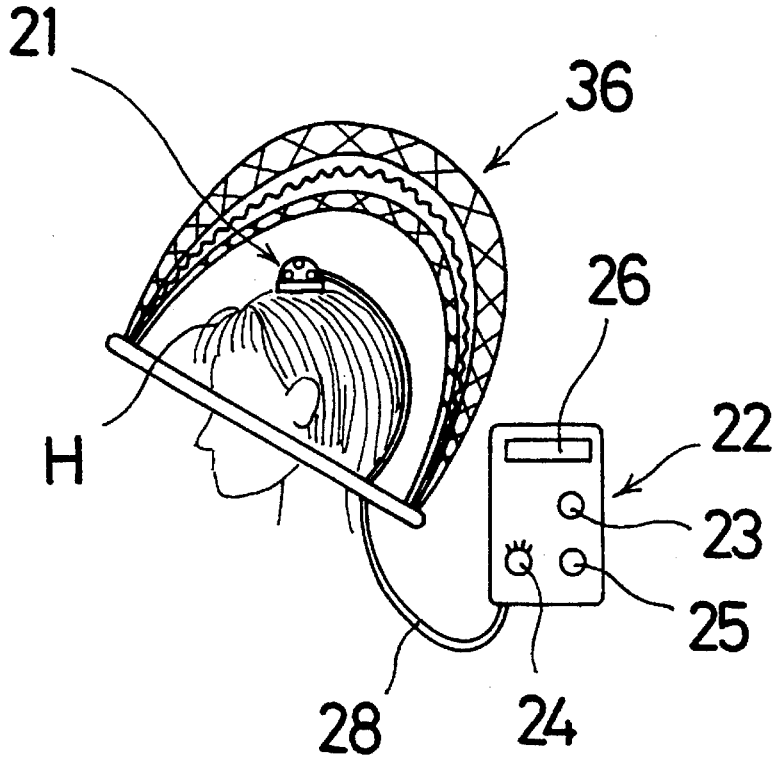
FIG. 15 shows the permanent wave apparatus of the invention.

In use, after the reducing agent has been applied to hair H, the temperature sensing device 21 is placed on the hair H and then the hair H is covered with the thermal insulation cap 36, as shown in FIG. 15. Thereupon, the power switch 23 of the temperature indicating device 22 is turned on, and the dial 24 is turned to set the first upper limit of hair temperature as determined for the hair H in advance. Then, the hair H is left in this condition under the room temperature.

Reduction reaction (first reduction reaction) starts in the hair H and produces heat and thus causes the surface temperature of the hair to increase. The surface temperature of the hair H, which thus increases as the reduction reaction proceeds, is detected incessantly by the sensor 30, and is indicated in the window 26. So the person to do the work of perming the hair can be conscious of how the reduction reaction proceeds in the hair by keeping watch on the temperature indicated in the window 26.

At the same time that the window 26 indicates the first upper limit of hair temperature, the alarm section 25 sounds an alarm to indicate that the reduction reaction has brought about the first reduced condition in the hair. Thereupon, the apparatus is removed, and then the reducing agent remaining on the hair is washed away.

During the above reduction reaction, or the first reduction, the hair is covered with the thermal insulation cap 36 and, therefore, the temperature inside the cap 36 is not affected by the outside temperature, and increases as the reduction reaction proceeds. Also, the temperature sensor 30 is not only mounted on the heat-insulating mat 27 but also is covered with the covering 29, so there is no possibility of the temperature sensor 30 coming into direct contact with the hair H or cap 36 and, therefore, the temperature of the hair surface is exactly measured by the sensor 30. Consequently, if the rate of proceeding of the reduction reaction is affected by, for example, a change in the room temperature, one is certainly informed (by an alarm sounded by the alarm section 25) that the reduction reaction has resulted in the first reduced condition of the hair.

Moreover, both the aluminum vapor layer 32 and urethane foam sheet 34 of the cap 36 are very effective in preventing a lowering of the temperature inside the cap 36 and, hence, the reduction reaction in the hair will lead to the first reduced condition therein in as short a time as possible.

As described above, according to the invention, the hair reducing operation comprises first and second reductions, so that both the reducing agent and the oxidizing agent act effectively on the hair in a well-balanced manner. For the same reason, not only is the end of the hair prevented from being curled excessively, but all the bunches of hair can be treated into very similar curled patterns. Also, according to the permanent wave method hereof, the reduction reaction as well as the oxidation reaction takes place and proceeds without producing almost any crack or strain the hair and, consequently, the hair can be waved without losing its gloss and softness.

Also, since the permanent wave apparatus of the invention automatically indicates that the first reduction reaction in the hair is complete, it can be used to treat all the bunches of hair into very similar curled patterns.

What is claimed is:

1. In a permanent method which includes a hair-reducing step and a hair-oxidizing step for changing a condition of hair from a first state to a second state, an improvement comprising (A) subdividing the hair-reducing step into a first reduction and a second reduction, the first reduction comprising applying a reducing agent to the hair in the first state and leaving the hair in this condition until the hair has been brought into a first reduced condition in which the hair is sufficiently soft and plastic to be readily manipulated into said second state, and the second reduction comprising heating the hair until the hair has been brought into a second reduced condition in which the hair is locked in the second state independently and without manipulation, (B) automatically determining when a reduction reaction initiated in the hair by applying the reducing agent to the hair has resulted in the first reduced condition of the hair, this determination being done based on a first-reducing temperature, or the temperature of the hair when the hair is in the first reduced condition, the first-reduction temperature being found out when the condition of the hair was changed from the first state to the second state for the first time, said determination being made by (i) placing on the hair temperature sensing means 21 that is connected to a temperature indicating device 22, (ii) covering the hair with a thermal insulation cap 36, (iii) entering the first-reduction temperature of the hair in the temperature indicating device 22, and (iv) causing the temperature indicating device 22 to automatically indicate when the first-reduction temperature has been reached, and (C) rinsing the hair immediately after the first reduction, the rinsing of the hair being followed by manipulating of the hair into said second state for the second reduction.

2. A permanent method in accordance with claim 1 wherein the reducing agent contains an ammonium salt of thioglycolic acid.

3. A permanent method in accordance with claim 1 wherein the reducing agent contains free ammonium as alkali.

4. A permanent method in accordance with claim 1 wherein the oxidizing agent contains sodium bromate.

5. A permanent method in accordance with claim 1 wherein the oxidizing agent contains hydrogen peroxide.

6. A permanent method in accordance with claim 1, wherein said first state is a straight condition of the hair and said second state is a curled condition of the hair.

7. A permanent method in accordance with claim 1, wherein said first state is a curled condition of the hair and said second state is a straight condition of the hair.

8. A permanent method for changing a condition of hair from a first state to a second state comprising:

implementing a first hair-reducing step by applying a reducing agent to the hair in the first state for a time duration sufficient to initiate a reduction reaction in the hair and to bring the hair into a first reduced condition in which the hair is sufficiently soft and plastic to be manipulated into the second state;

automatically determining when said reduction reaction implemented in said first hair-reducing step has resulted in the first reduced condition of the hair, said step of automatically determining based on a previous identification of a first-reducing temperature of the hair, attained by the hair when the hair is in the first reduced condition;

after said time duration of said first hair-reducing step, manipulating the hair into the second state;

implementing a second hair reducing-step by heating the hair manipulated into the second state until the hair has been brought into a second reduced condition in which the hair is locked in the second state independently and without manipulation; and oxidizing the hair by application of an oxidizing agent thereto;

wherein said step of automatically determining comprises:

placing on the hair a temperature sensing means connected to a temperature indicating device;

covering the hair with a thermal insulation cap;

entering the first-reduction temperature of the hair in the temperature indicating device; and providing an automatic indication on the temperature indicating device when the first-reduction temperature is sensed by the temperature sensing means.

9. A permanent method in accordance with claim 8, wherein the step of applying a reducing agent to the hair comprises applying the reducing agent to the hair in a non-uniform manner, by applying greater quantities to the hair adjacent root portions thereof than at distal portions thereof.

10. A permanent method in accordance with claim 8, wherein said previous identification comprises a step of observing the first-reduction temperature when the hair is changed from the first state to the second state for the first time.

11. A permanent method in accordance with claim 8, wherein said first state is a straight condition of the hair and said second state is a curled condition of the hair.

12. A permanent method in accordance with claim 8, wherein said first state is a curled condition of the hair and said second state is a straight condition of the hair.

* * * * *